US011746793B2

(12) United States Patent
Chiu

(10) Patent No.: US 11,746,793 B2
(45) Date of Patent: Sep. 5, 2023

(54) FAN INCLUDING MAGNETICALLY LEVITATED BLADE ASSEMBLY

(71) Applicant: Yung Shun Chiu, Kaohsiung (TW)

(72) Inventor: Yung Shun Chiu, Kaohsiung (TW)

( * ) Notice: Subject to any disclaimer, the term of this patent is extended or adjusted under 35 U.S.C. 154(b) by 304 days.

(21) Appl. No.: 17/100,952

(22) Filed: Nov. 23, 2020

(65) Prior Publication Data

US 2021/0156387 A1 May 27, 2021

(30) Foreign Application Priority Data

Nov. 27, 2019 (TW) ..... 108215744

(51) Int. Cl.

| | |
|---|---|
| ***F04D 29/52*** | (2006.01) |
| ***F04D 29/048*** | (2006.01) |
| ***F04D 25/08*** | (2006.01) |
| ***F04D 25/06*** | (2006.01) |
| ***F04D 29/40*** | (2006.01) |

(52) U.S. Cl.

CPC ..... *F04D 25/0606* (2013.01); *F04D 25/06* (2013.01); *F04D 29/403* (2013.01); *F04D 29/526* (2013.01); *F04D 25/08* (2013.01); *F04D 29/048* (2013.01)

(58) Field of Classification Search

CPC ..... F04D 29/002
USPC ..... 416/189, 192
See application file for complete search history.

(56) References Cited

U.S. PATENT DOCUMENTS

| | | | | |
|---|---|---|---|---|
| 4,553,075 A * | 11/1985 | Brown | F04D 25/066 310/68 R |
| 5,075,606 A * | 12/1991 | Lipman | F04D 25/066 310/63 |
| 6,606,578 B1 * | 8/2003 | Henderson | B64D 27/24 702/145 |
| 7,402,932 B2 * | 7/2008 | Applegate | H02K 21/14 310/112 |
| 2011/0030929 A1 * | 2/2011 | Powell | F28F 13/12 165/121 |

* cited by examiner

*Primary Examiner* — Nathan C Zollinger
*Assistant Examiner* — Timothy P Solak
(74) *Attorney, Agent, or Firm* — BRUCE STONE LLP; Joseph A. Bruce

(57) ABSTRACT

A fan includes an annular frame, a rail assembly, a driving member and blades. The blades are connected to the driving member. The driving member is electromagnetically movable along the magnetic levitation assembly that extends along an edge of the annular frame. The driving member does not contact the annular frame or the magnetic levitation assembly so that when the fan is used, the magnetic levitation assembly is energized to generate an electromagnetic force between the magnetic levitation assembly and the driving member to move the driving member along the edge of the annular frame to drive the blades to rotate. Therefore, the blades can be rotated without having to use any motor behind the annular frame, thereby reducing the volume of the fan.

1 Claim, 15 Drawing Sheets

FAN INCLUDING MAGNETICALLY LEVITATED BLADE ASSEMBLY

BACKGROUND OF INVENTION

1. Field of Invention

The present invention relates to a fan cutter and, more particularly, to a compact and quiet fan including magnetically levitated blade assembly.

2. Related Prior Art

Fans are common electric appliances in many homes. The purchase and use of fans are less expensive than the purchase and use of air conditioners.

Referring to FIG. 1, a conventional fan 1 includes a frame 10, a motor 11 supported on the frame 10, a propeller 12 operatively connected to a mandrel 14 of the motor 11. The motor 11 is energized to rotate the propeller 12 to generate wind. However, the motor 11 is bulky and hence occupies a lot of space. Moreover, the motor 11 inevitably produces a considerable noise in operation.

The present invention is therefore intended to obviate or at least alleviate the problems encountered in the prior art.

SUMMARY OF INVENTION

It is the primary objective of the present invention to provide a compact and quiet fan.

To achieve the foregoing objective, the fan includes an annular frame, a magnetic levitation assembly, blades and movable elements. The magnetic levitation assembly is connected to the annular frame. Each of the movable elements is connected to an external end of a corresponding one of the blades and kept floating by the magnetic levitation assembly.

In another aspect, a fan includes internal and external annular frames, internal and external magnetic assemblies, internal and external movable elements, and internal and external blades. The internal magnetic levitation assembly is connected to the internal annular frame. The internal movable elements are kept floating by the internal magnetic levitation assembly. Each of the internal blades includes an end connected to a corresponding one of the internal movable elements. The external annular frame extends around the internal annular frame. The external magnetic levitation assembly is connected to the external annular frame. The external movable elements are kept floating by the external magnetic levitation assembly. Each of the external blades includes an end connected to a corresponding one of the external movable elements and another end connected to the internal annular frame.

In another aspect, a fan includes internal, external and intermediate annular frames, internal, external and intermediate magnetic assemblies, internal, external and intermediate movable elements, and internal and external blades. The internal magnetic levitation assembly is connected to the internal annular frame. The internal movable elements are kept floating by the internal magnetic levitation assembly. Each of the internal blades includes an end connected to a corresponding one of the internal movable elements. The external annular frame extends around the internal annular frame. The external magnetic levitation assembly is connected to the external annular frame. The external movable elements are kept floating by the external magnetic levitation assembly. The intermediate annular frame is connected to the internal annular frame. The intermediate magnetic levitation assembly is connected to the intermediate annular frame. The intermediate movable elements are kept floating by the intermediate magnetic levitation assembly. Each of the external blades includes an end connected to a corresponding one of the external movable elements and another end connected to a corresponding one of the intermediate movable elements.

Other objectives, advantages and features of the present invention will be apparent from the following description referring to the attached drawings.

BRIEF DESCRIPTION OF DRAWINGS

The present invention will be described via detailed illustration of six embodiments versus the prior art referring to the drawings wherein.

DETAILED DESCRIPTION OF EMBODIMENTS

Figure 1:
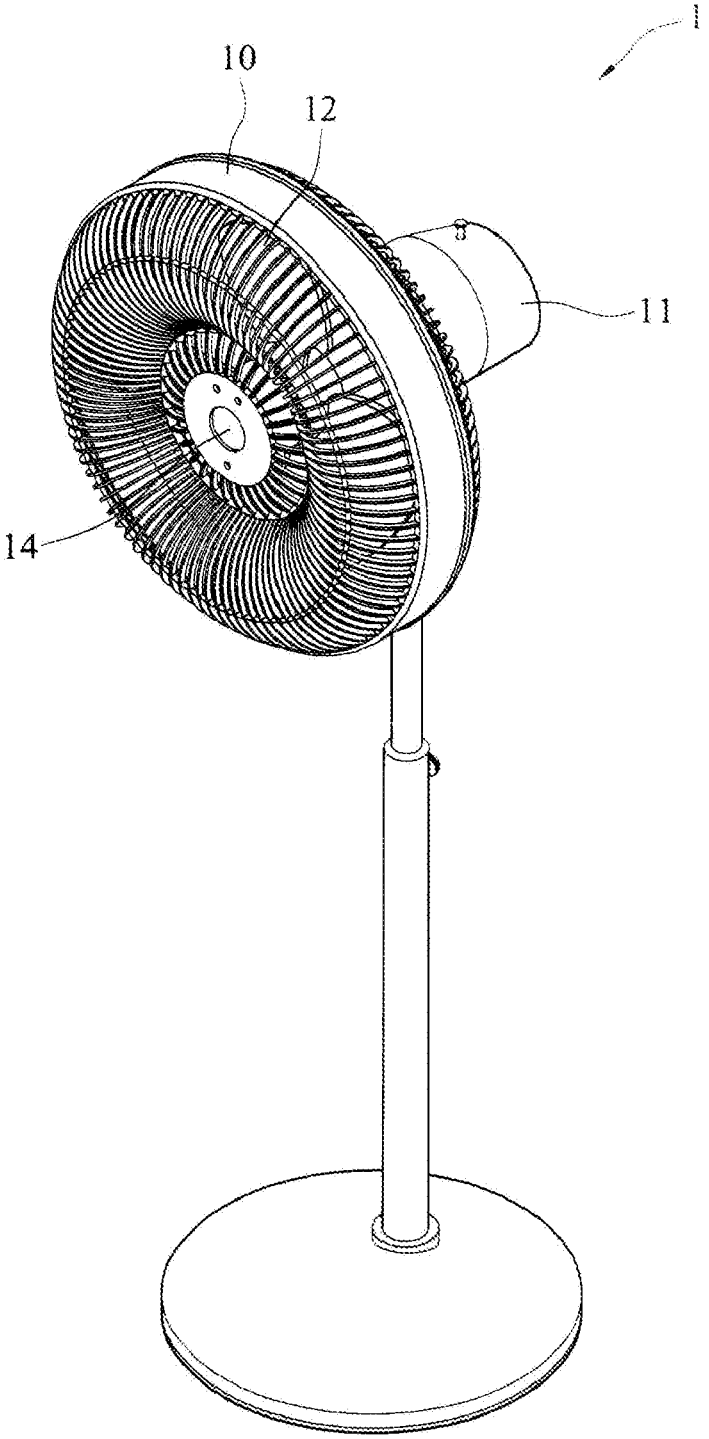
FIG. 1(Prior Art)
FIG. 1 is a perspective view of a conventional fan.
Figure 2:
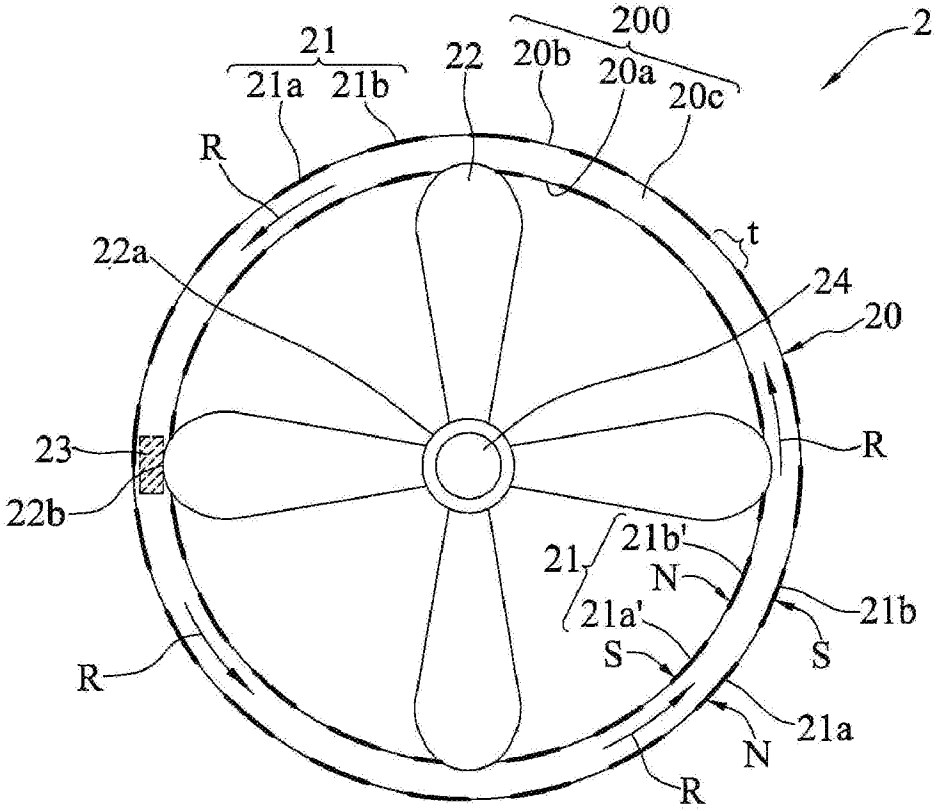
FIG. 2 is a rear view of a fan according to the first embodiment of the present invention.
Figure 3:
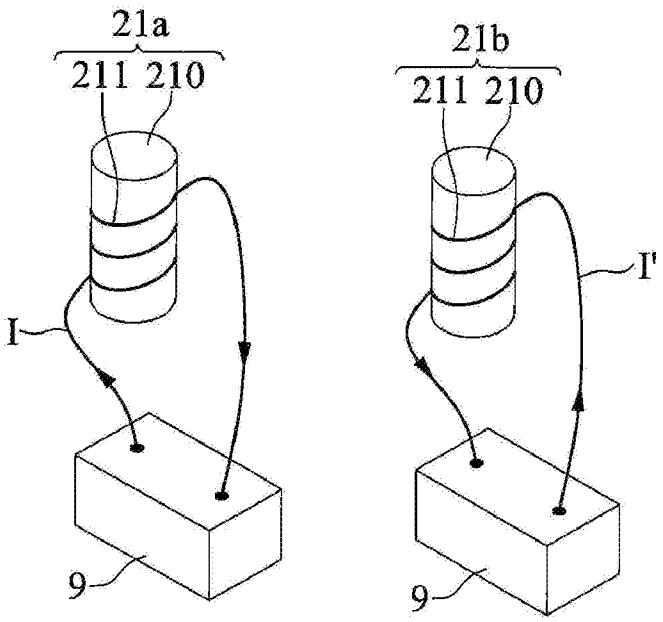
FIG. 3 is a perspective view of two electromagnets of the fan shown in FIG. 2.
Figure 4:
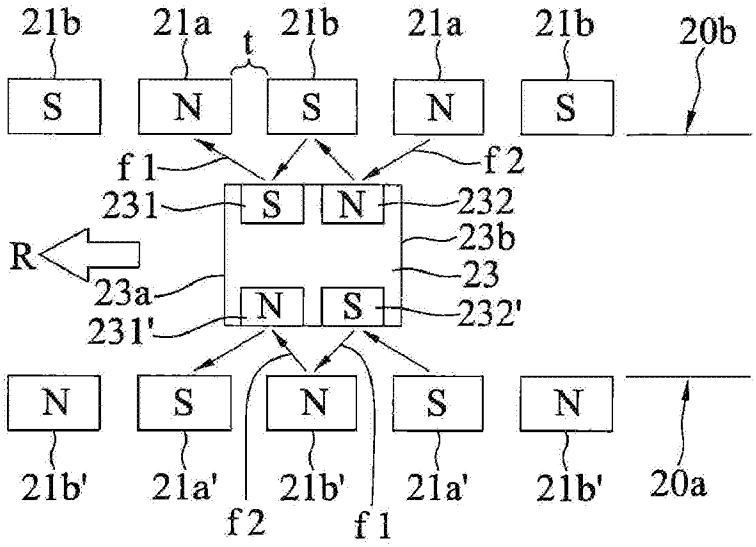
FIG. 4 is a simplified diagram of the generation of an electromagnetic force by the fan shown in FIG. 2.

Referring to FIGS. 2 through 4, a fan 2 includes a frame 20, a magnetic levitation assembly 21, a propeller (not numbered) and movable elements 23 according to a first embodiment of the present invention. The frame 20 is an annular element extending in a circle. The frame 20 is made of an electrically insulating (or "non-conductive") material to facilitate the operation of the fan 2. The frame 20 includes a groove 200 in a front face. The groove 200 is defined by internal strip 20*a*, an external strip 20*b* and a rear strip 20*c* to allow access to the groove 200 from the front face of the frame 20.

The magnetic levitation assembly 21 is located in the groove 200. Details of the magnetic levitation assembly 21 will be given later.

The propeller includes blades 22 extending from a hub 24 in a radial manner. Each of the blades 22 includes an end 22*a* connected to the hub 24 by welding or ultrasonic welding. Preferably, the blades 22 and the hub 24 are made in one piece.

Preferably, the number of the blades 22 is identical to the number of the movable elements 23 to achieve balance in rotation. Each of the movable elements 23 is connected to another end 22*b* of a corresponding one of the blades 22.

The magnetic levitation assembly 21 includes pairs of electromagnets 21*a* and 21*b* attached to the external strip 20*b* and pairs of electromagnets 21*a*' and 21*b*' attached to the internal strip 20*a*. Thus, the electromagnets 21*a*, 21*b*, 21*a*' and 21*b*' are located in the groove 200.

Referring to FIG. 3, the electromagnets 21*a*, 21*b*, 21*a*' and 21*b*' are identical to one another in structure. Each of the electromagnets 21*a*, 21*b*, 21*a*' and 21*b*' includes a solenoid 211 extending around a metal core 210. The solenoid 211 is electrically connected to a controller 9.

In each of the electromagnets 21*a*, the controller 9 sends a current I to the solenoid 211 to generate a magnetic field. In each of the electromagnets 21*b*, the controller 9 sends a current I' to the solenoid 211 to generate a magnetic field.

In each of the electromagnets 21*a*', the controller 9 sends a current I to the solenoid 211 to generate a magnetic field. In each of the electromagnets 21*b*', the controller 9 sends a current I' to the solenoid 211 to generate a magnetic field.

Referring to FIG. 2, the electromagnets 21*a* and 21*b* are alternately located along the external strip 20*b* since they are arranged in pairs. The electromagnets 21*a*' and 21*b*' are alternately located along the internal strip 20*a* since they are arranged in pairs.

Referring to FIG. 4, the pairs of electromagnets 21*a* and 21*b* and the pairs of electromagnets 21*a*' and 21*b*' are arranged like in a stator of a motor. For example, each of the electromagnets 21*a* generates an N-pole (or S-pole) toward the internal strip 20*a*, and each of the electromagnets 21*b* generates a S-pole (or N-pole) toward the internal strip 20*a*. For example, each of the electromagnets 21*a*' generates a S-pole (or N-pole) pointed at a corresponding one of the electromagnets 21*a*, and each of the electromagnets 21*b*' generates an N-pole (or S-pole) pointed at a corresponding one of the electromagnets 21*b*.

One of the movable elements 23 is shown and will be called "the movable element 23" in the description referring to FIG. 4. The movable element 23 includes four magnets 231, 232, 231' and 232'. The magnets 231 and 232 are located in the vicinity of a side of the movable element 23. The magnets 231' and 232' are located in the vicinity of an opposite side of the movable element 23. The magnets 231 and 231' are located in the vicinity of an end 23*a* of the movable element 23. The magnets 232 and 232' are located in the vicinity of an opposite end 23*b* of the movable element 23.

For example, the magnet 231 generates a S-pole (or N-pole) toward the pairs of electromagnets 21*a* and 21*b*. For example, the magnet 232 generates an N-pole (or S-pole) toward the pairs of electromagnets 21*a* and 21*b*. For example, the magnet 231' generates an N-pole (or S-pole) toward the pairs of electromagnets 21*a*' and 21*b*'. For example, the magnet 232' generates a S-pole (or N-pole) toward the pairs of electromagnets 21*a*' and 21*b*'.

The magnet 231 is attracted to each of the electromagnets 21*a* as indicated by an arrow head f1, but repulsed from each of the electromagnets 21*b* as indicated by an arrow head f2. The magnet 232 is attracted to each of the electromagnets 21*b* as indicated by an arrow head f1, but repulsed from each of the electromagnets 21*a* as indicated by an arrow head f2. The magnet 231' is attracted to each of the electromagnets 21*a*' as indicated by an arrow head f1, but repulsed from each of the electromagnets 21*b*' as indicated by an arrow head f2. The magnet 232' is attracted to each of the electromagnets 21*b*' as indicated by an arrow head f1, but repulsed from each of the electromagnets 21*a*' as indicated by an arrow head f2. Thus, the movable element 23 is moved and kept floating by the magnetic levitation assembly 21.

Referring to FIG. 2, the propeller, which includes the blades 22 connected to the hub 24, is rotated as the movable elements 23, which are connected to the blades 22, are moved in and along the groove 200 of the frame 20. The propeller is quiet in rotation.

Figure 5:
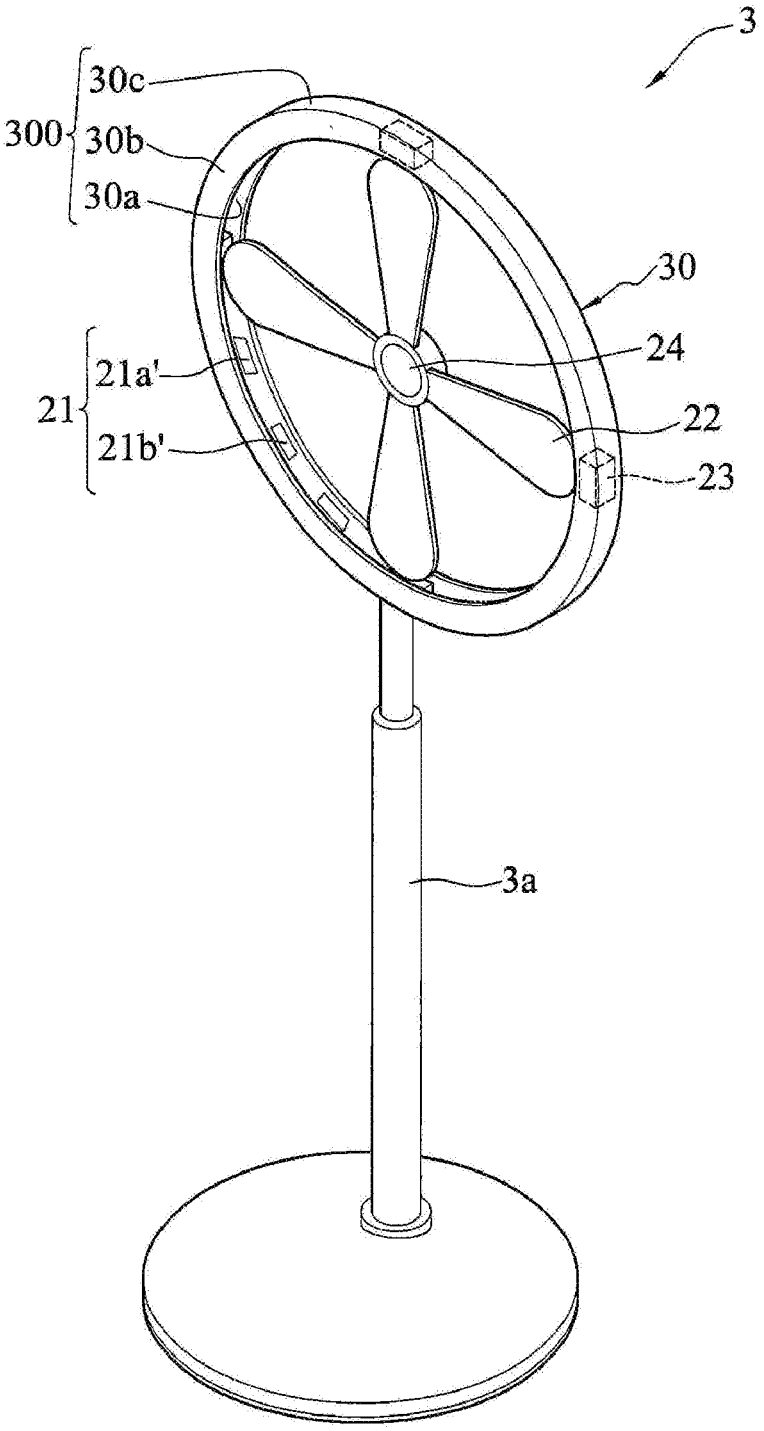
FIG. 5 is a perspective view of a fan according to the second embodiment of the present invention.
Figure 6:
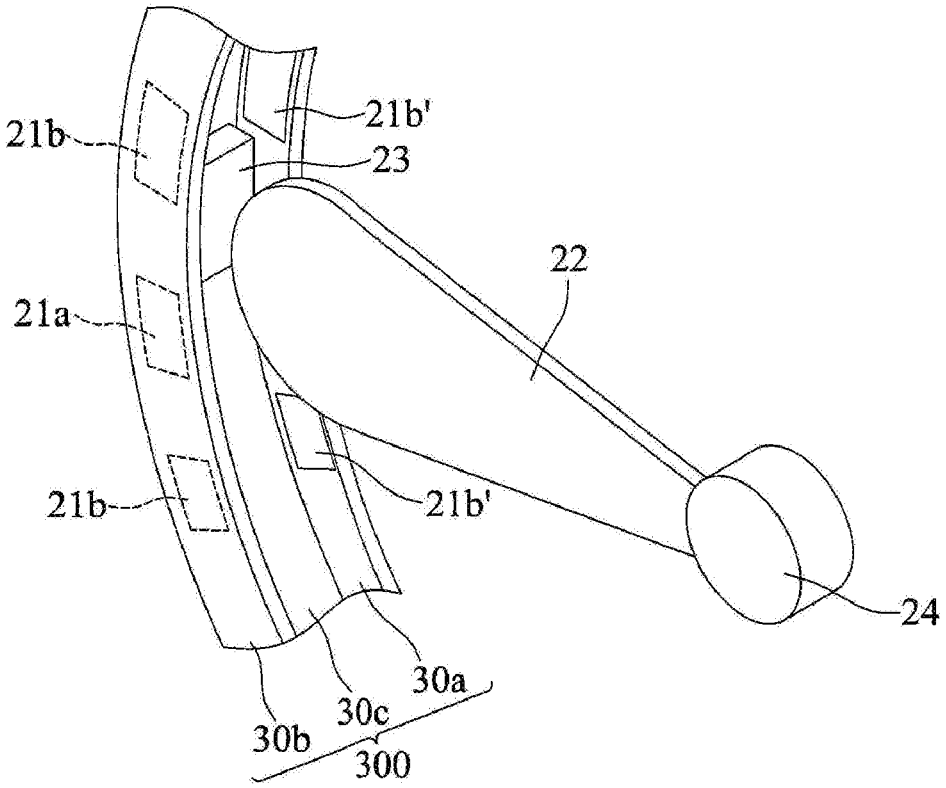
FIG. 6 is an enlarged partial view of the fan shown in FIG. 5.
Figure 7:
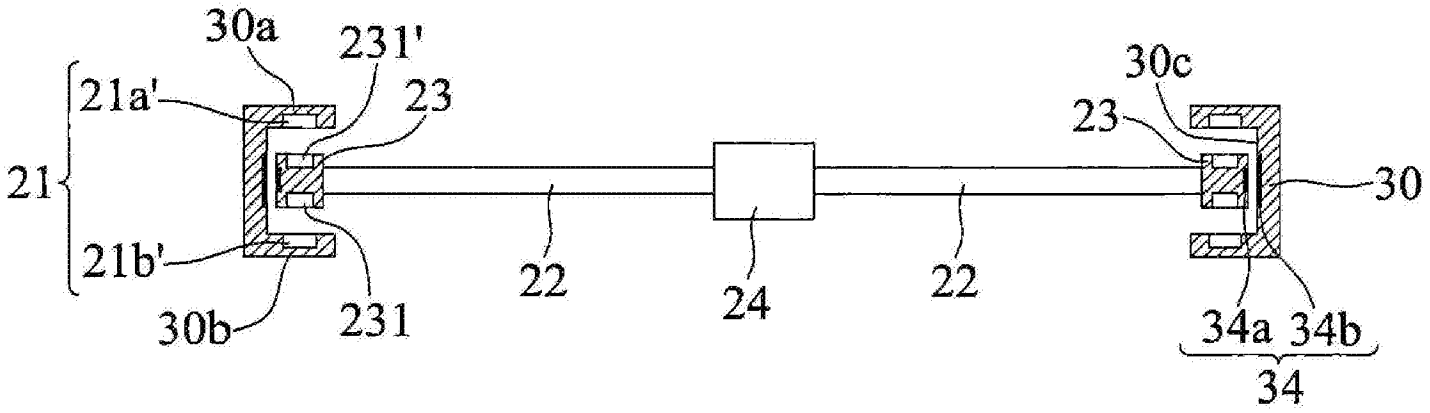
FIG. 7 is a cross-sectional view of the fan shown in FIG. 5.

Referring to FIGS. 5 to 7, there is shown a fan 3 in accordance with a second embodiment of the present invention. The fan 3 is identical to the fan 2 except for two things. Firstly, there is a frame 30 instead of the frame 20. The frame 30 includes a groove 300 made in an internal face. Hence, the groove 300 is defined by a rear strip 30*a*, a front strip 30*b* and a circumferential strip 30*c*. The pairs of electromagnets 21*a*' and 21*b*' are attached to the rear strip 30*a*. The pairs of electromagnets 21*a* and 21*b* are attached to the front strip 30*b*.

Secondly, there is an additional magnetic assembly 34. The magnetic assembly 34 includes an additional magnet 34 attached to each of the movable elements 23 and a magnet 34*b* attached to the frame 30. The magnet 34*b* is preferably an annular element fitted in the groove 300. The magnet 34*b* can however be replaced with magnets in the form of blocks.

Thirdly, there is an additional post 3*a*. An upper end of the post 3*a* is connected to the frame 30. A lower end of the post 3*a* is connected to a base (not numbered).

Figure 8:
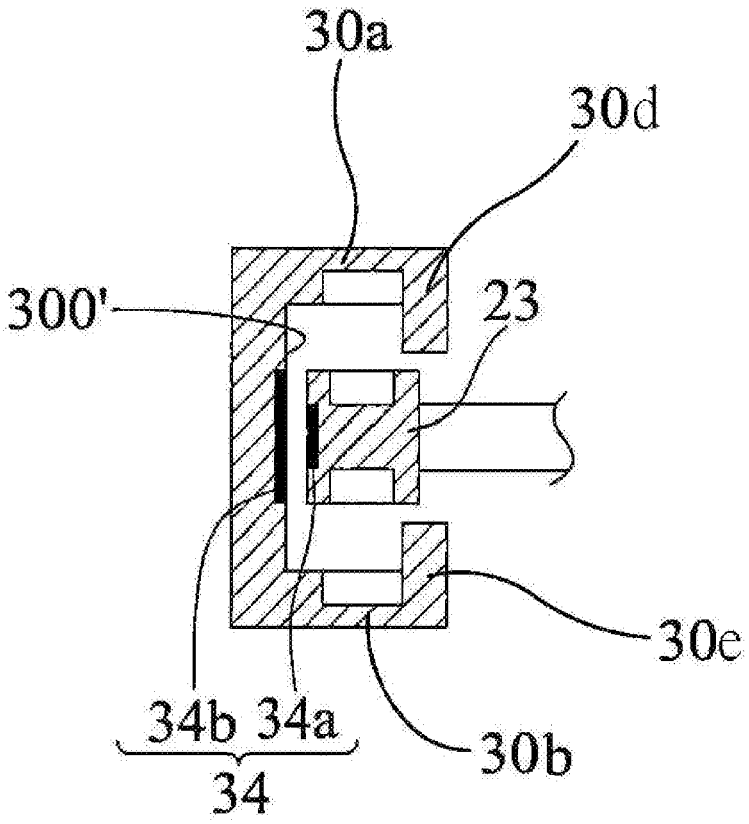
FIG. 8 is an enlarged partial cross-sectional view of a fan according to the third embodiment of the present invention.

Referring to FIG. 8, there is shown a fan 3 according to a third embodiment of the present invention. The third embodiment is identical to the second embodiment except that the frame 300' includes two flanges 30*d* and 30*e*. The flange 30*d* extends from the rear strip 30*a*. The flange 30*e* extends from the front strip 30*b*. The flanges 30*d* and 30*e* extend toward each other.

Figure 9:
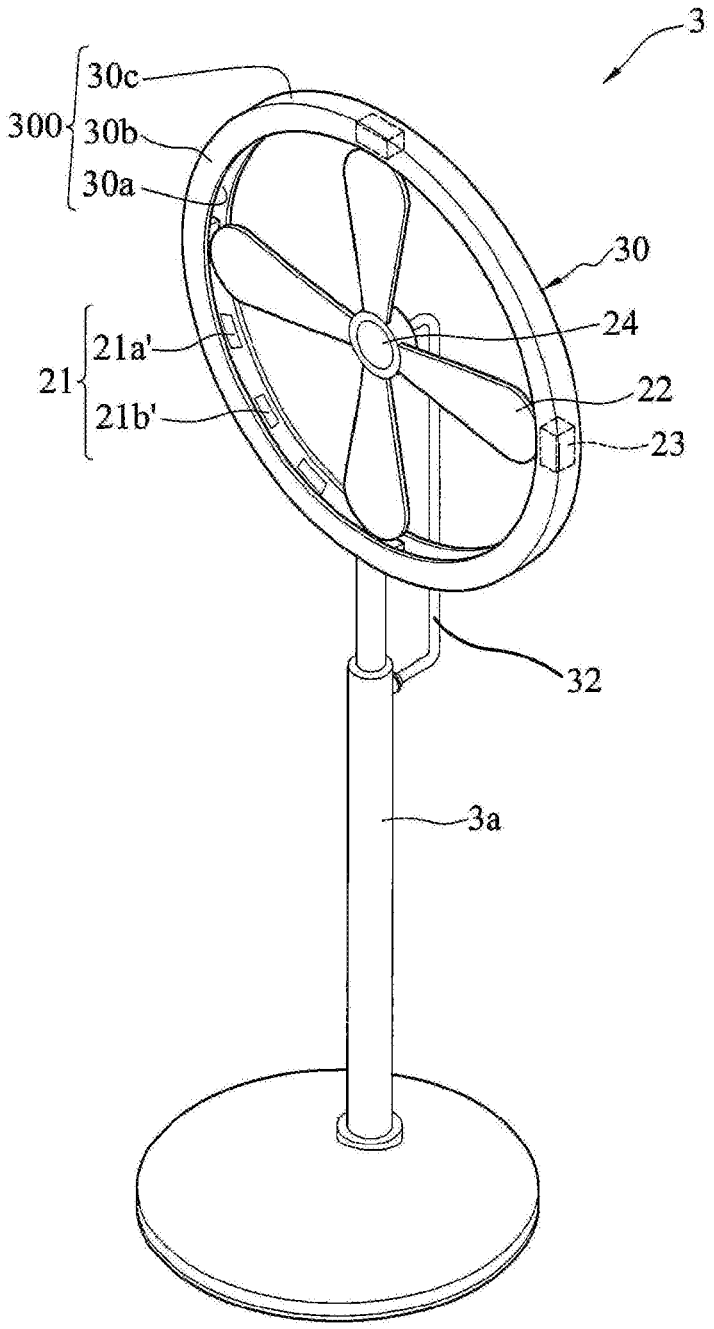
FIG. 9 is a perspective view of a fan according to the fourth embodiment of the present invention.

Referring to FIG. 9, there is shown a fan 3 according to a fourth embodiment of the present invention. The fourth embodiment is identical to the second embodiment except for including an additional supporting element 32. The supporting element 32 is a rod formed with a lower bent end and an upper bent end. The lower bent end of the supporting element 32 is connected to the post 3*a*. The hub 24 is supported on the upper bent end of the supporting element 32. The magnets 34*a* and 34*b* can be saved because of the use of the supporting element 32.

Figure 10:
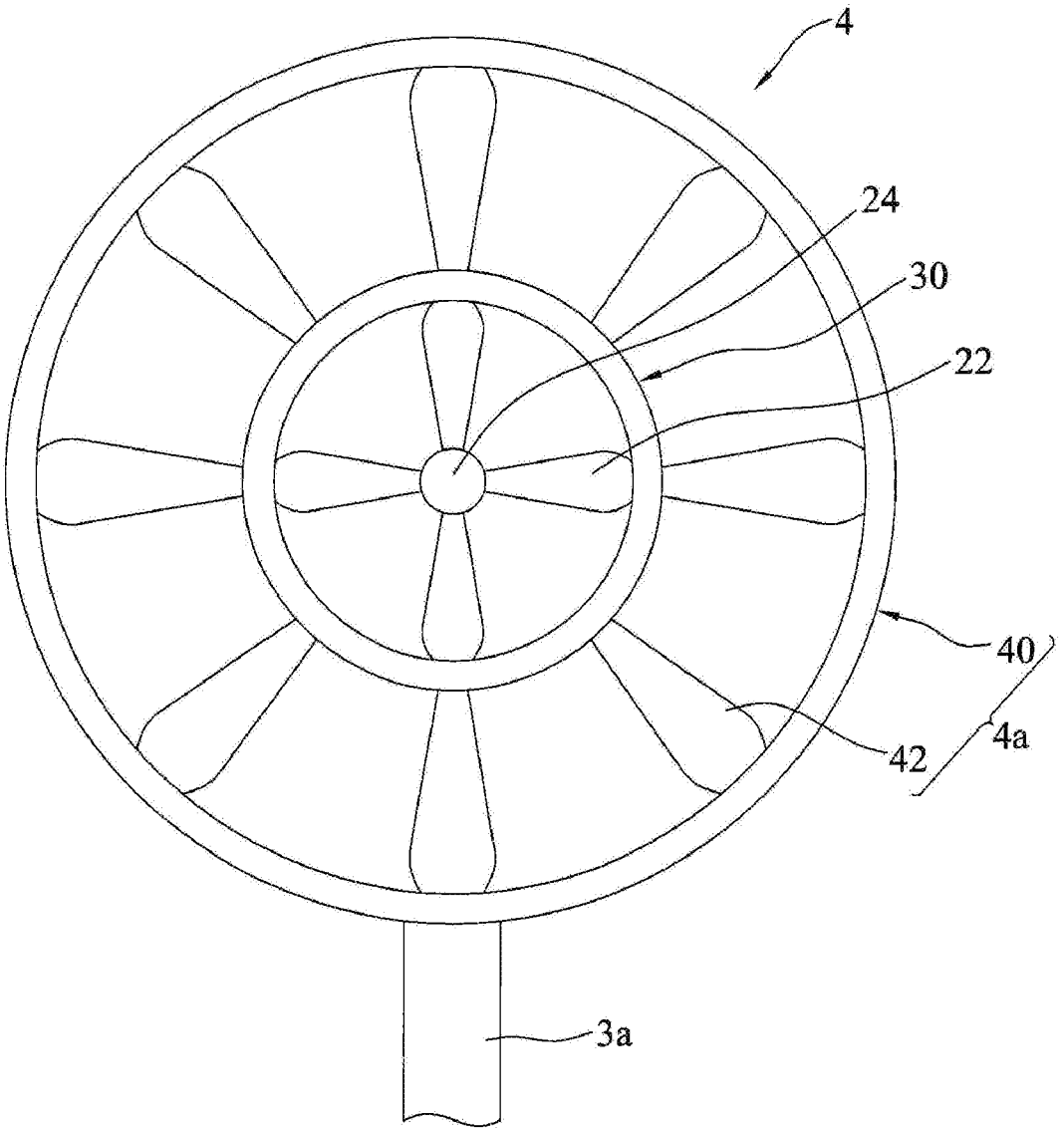
FIG. 10 is a front view of a fan according to the fifth embodiment of the present invention.
Figure 11:
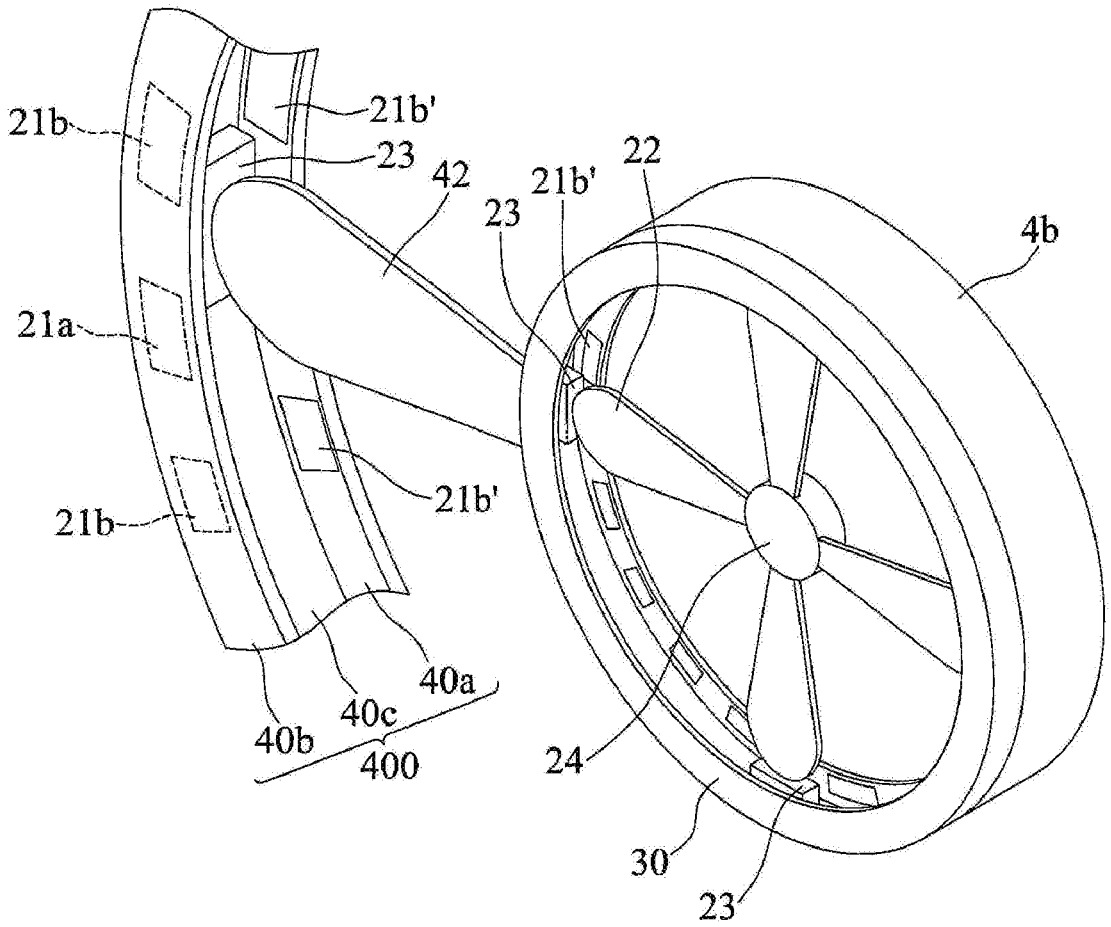
FIG. 11 is an enlarged partial view of the fan shown in FIG. 10.

Referring to FIGS. 10 and 11, there is a fan 4 according to a fifth embodiment of the present invention. The fifth embodiment is like the second embodiment except for including a circumferential fan 4*a* and a rear frame 4*b* in addition. The circumferential fan 4*a* includes a frame 4, blades 42 and an external magnetic levitation assembly 21. Like each of the blades 22, each of the blades 42 includes an end connected to the frame 30 and another end connected to an external movable element 23. Like the frame 30, the frame 40 includes a groove 400 defined by a rear strip 40*a*, a front strip 40*b* and a circumferential strip 40*c*. The external magnetic levitation assembly 21 is located in the groove 400. The frame 30 is rotationally supported on the rear frame 4*b*. The rear frame 4*b* is supported on the post 3*a*.

In operation, the external magnetic levitation assembly 21 keeps the external movable elements 23 floating and moving, thereby keeping the blades 42 in rotation. Preferably, the rotation of the blades 42 is in an opposite sense of direction to the rotation of the blades 22. In another embodiment, the sense of direction of the rotation of the blades 42 is identical to the sense of direction of the rotation of the blades 22.

In another embodiment, there can be another circumferential fan arranged around the circumferential fan 4*a*.

Figure 12:
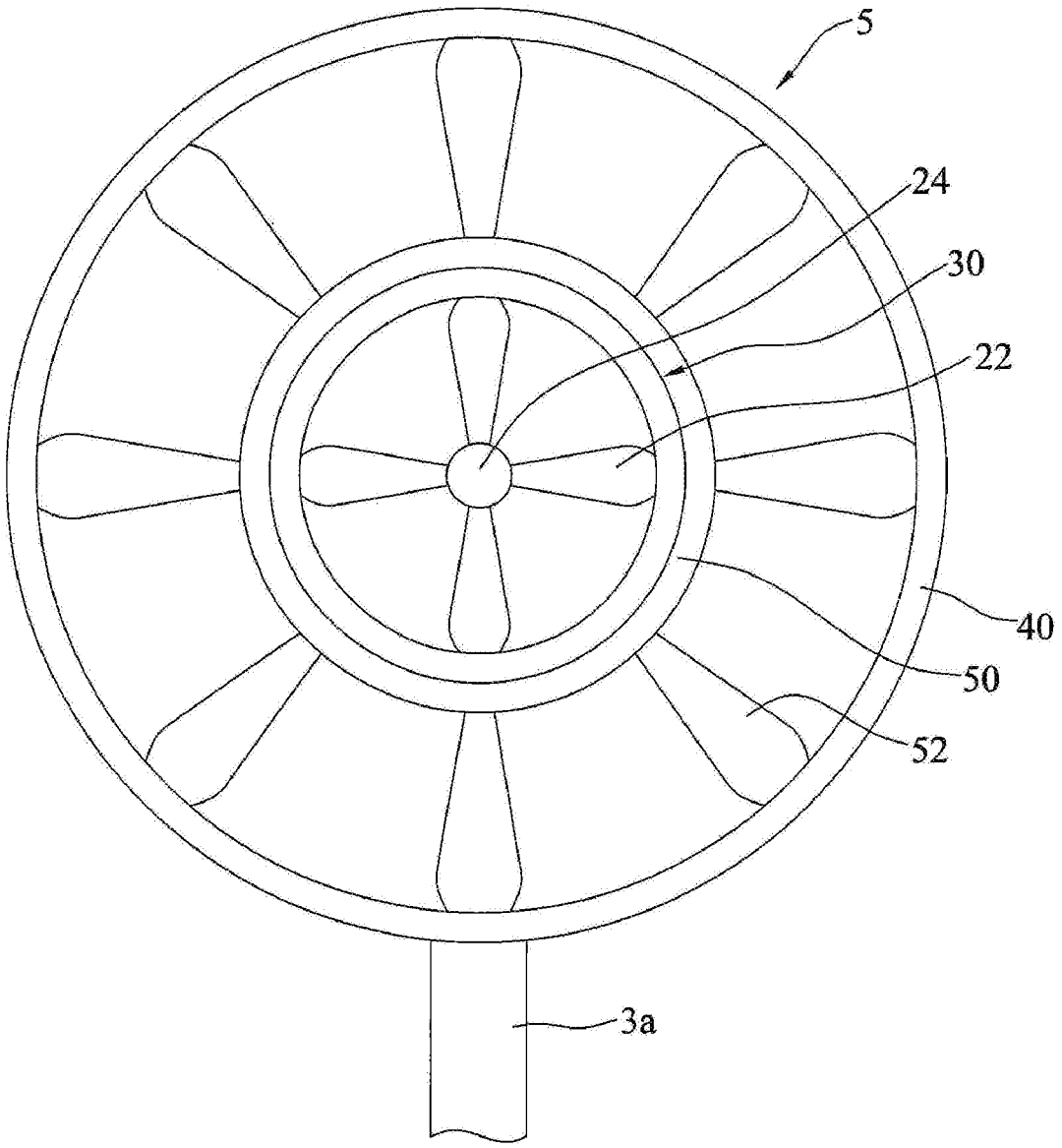
FIG. 12 is a front view of a fan according to the sixth embodiment of the present invention.
Figure 13:
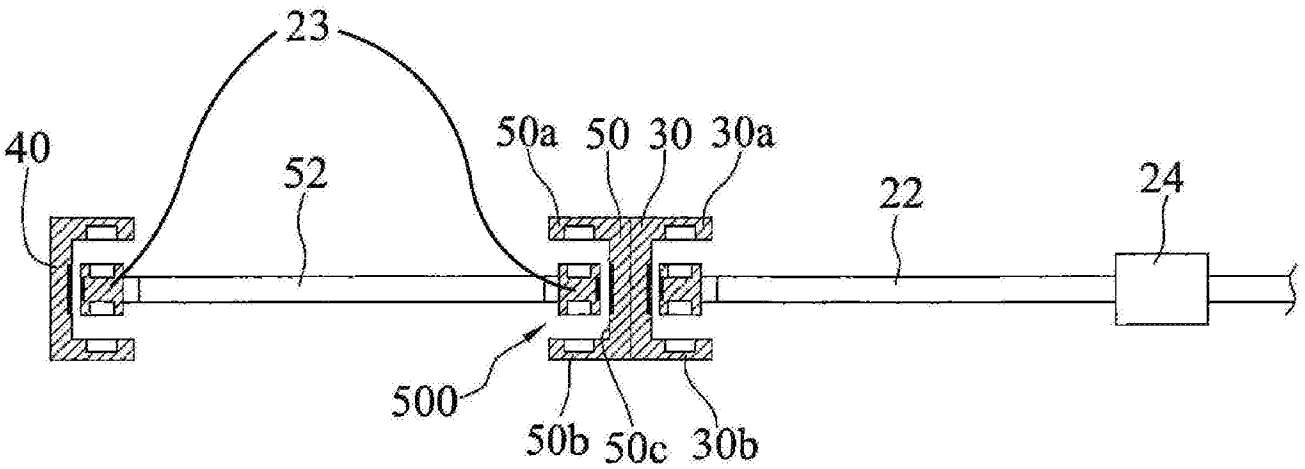
FIG. 13 is a cross-sectional view of the fan shown in FIG. 12.

Referring to FIGS. 12 and 13, there is a fan 5 according to a sixth embodiment of the present invention. The sixth embodiment is like the fifth embodiment except for several things. Firstly, a supplementary frame 50 is connected to the frame 30. Like the frame 30, the supplementary frame 50 includes a groove 500 defined by a rear strip 50*a*, a front strip 50*b* and a circumferential strip 50*c*. Secondly, an intermediate magnetic levitation assembly 21 is located in the groove 500. Thirdly, blades 52 are used instead of the blades 42. Each of the blades 52 includes an end connected to an intermediate movable element 23 and another end connected to a corresponding one of the external movable elements 23.

In use, the external and intermediate magnetic assemblies 21 keep the external and intermediate movable elements 23 floating and moving, thereby keeping the blades 52 in rotation. Preferably, the rotation of the blades 52 is in an opposite sense of direction to the rotation of the blades 22. In another embodiment, the sense of direction of the rotation of the blades 52 is identical to the sense of direction of the rotation of the blades 22.

Figure 14:
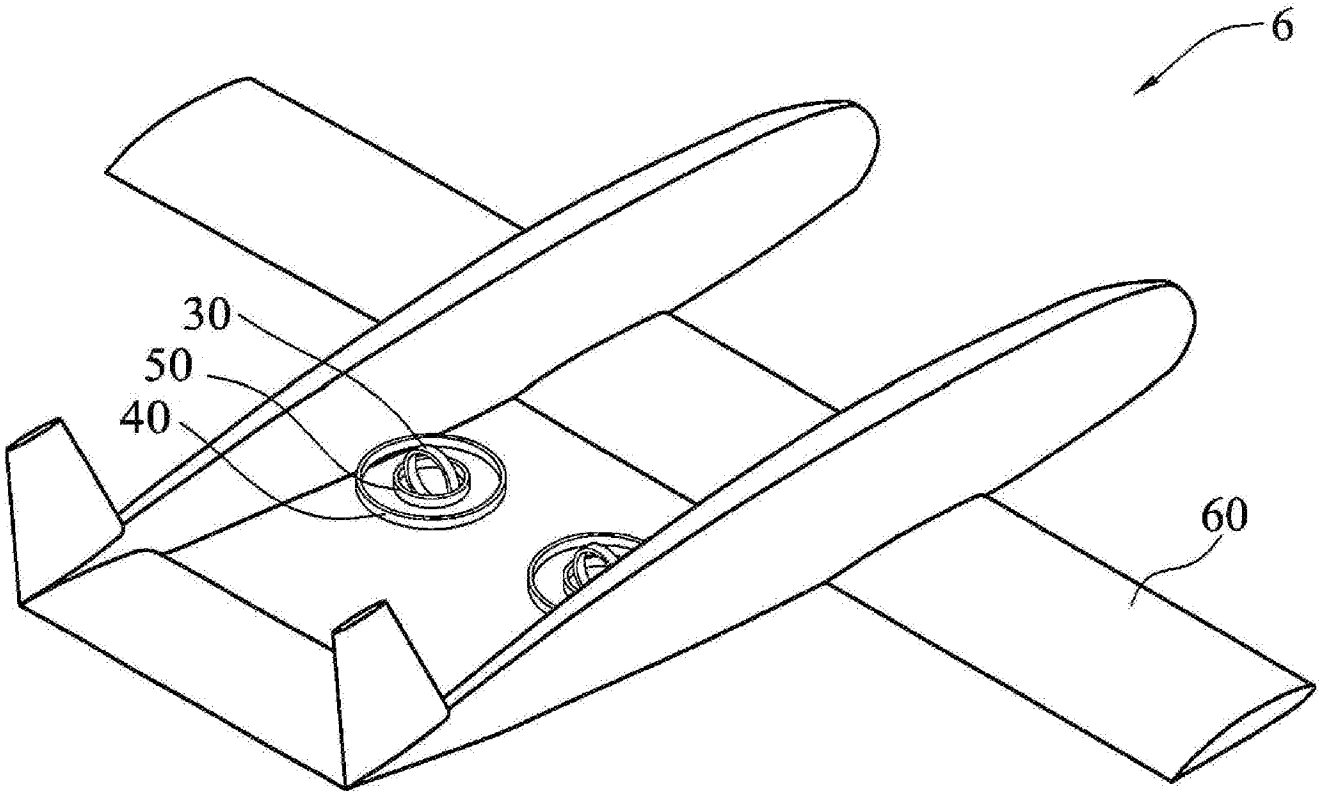
FIG. 14 is a perspective view of a done provided with two fans as shown in FIG. 13.

Referring to FIG. 14, a drone 6 that includes a wing 60 is provided with two fans 5 without any posts 3*a*. The frames 40 and 50 extend in a horizontal plane. Thus, the blades 52 propel air downward to lift the drone 6. The frame 30 extends in a vertical plane. Thus, the blades 22 propel air backward to drive the drone 6 forward.

Figure 15:
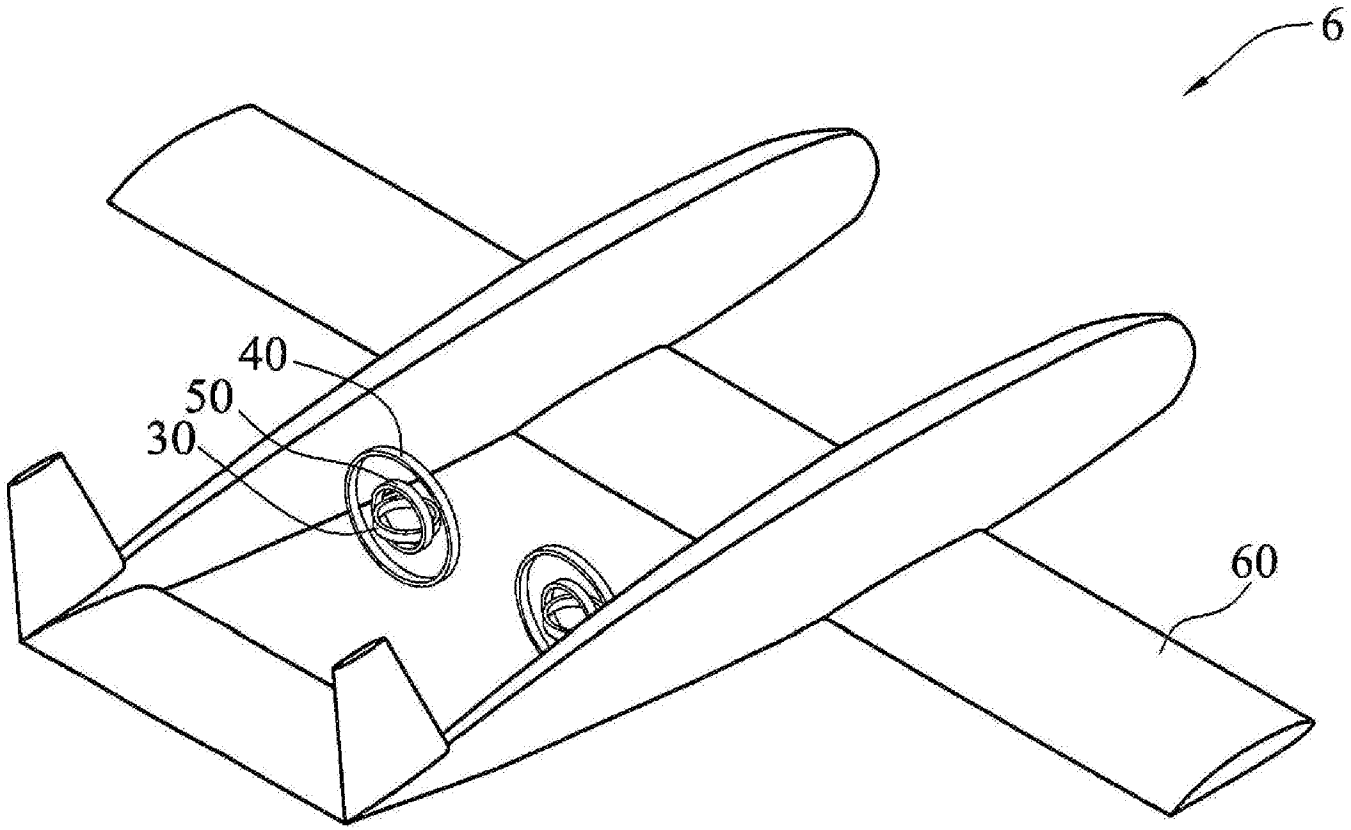
FIG. 15 is a perspective view of the done, with the fans located in another position than shown in FIG. 14.

Referring to FIG. 15, the frames 40 and 50 extend in a vertical plane. Thus, the blades 52 propel air backward to drive the drone 6 forward. The frame 30 extends in a horizontal plane. Thus, the blades 22 propel air downward to lift the drone 6.

Advantageously, the blades 22, 42 or 52 are rotated by the movable elements 23 and the magnetic levitation assembly 21, not a motor that is attached to a rear portion of a conventional fan and thus renders the conventional fan bulky. Hence, the fan 2, 3, 4 or 5 of the present invention is compact.

Moreover, the movable elements 23 are kept floating during the rotation of the blades 22, 42 or 52. There is no friction between the movable elements 23 and the frame 20, 30, 40 or 50. Furthermore, there is no friction between the hub 24 and a mandrel of a motor. Hence, the fan 2, 3, 4 or 5 of the present invention is quiet in operation.

The fan 2, 3, 4 or 5 of the present invention can be used to cool an electronic device. For example, the fan 2, 3, 4 or 5 of the present invention can be used in a computer or a projector.

The fan 2, 3, 4 or 5 of the present invention can be used to evenly distribute heat in an electronic device. For example, the fan 2, 3, 4 or 5 of the present invention can be used in a microwave oven.

The fan 2, 3, 4 or 5 of the present invention can be used to drive a vehicle. For example, the fan 2, 3, 4 or 5 of the present invention can be used on s a drone, a hover craft or a swamp boat.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A fan comprising:

an internal annular frame;

an internal magnetic levitation assembly connected to the internal annular frame;

internal movable elements kept floating by the internal magnetic levitation assembly;

internal blades each of which comprises an end connected to a corresponding one of the internal movable elements; and an external annular frame extending around the internal annular frame;

an external magnetic levitation assembly connected to the external annular frame;

external movable elements kept floating by the external magnetic levitation assembly; and external blades each of which comprises an end connected to a corresponding one of the external movable elements and another end connected to the internal annular frame.

* * * * *